United States Patent [19]

Olson

[11] Patent Number: 5,054,707

[45] Date of Patent: Oct. 8, 1991

[54] WINDER RIDER ROLL

[75] Inventor: Jayme B. Olson, Neenah, Wis.

[73] Assignee: American National Can Company, Chicago, Ill.

[21] Appl. No.: 848,069

[22] Filed: Apr. 4, 1986

[51] Int. Cl.[5] ..... B65H 18/10; B65H 19/22; B65H 18/26

[52] U.S. Cl. ..... 242/64; 242/56 A; 242/67.1 R

[58] Field of Search ..... 242/56 A, 64, 75.1, 242/75.2, 67.1 R

[56] References Cited

U.S. PATENT DOCUMENTS

| | | | |
|---|---|---|---|
| 2,334,793 | 11/1943 | Scusa | 242/64 |
| 3,478,975 | 11/1969 | Penrod | 242/64 |
| 4,431,140 | 2/1984 | Tetro | 242/56 A |
| 4,524,919 | 6/1985 | Wehrmann | 242/67.1 R |
| 4,529,141 | 7/1985 | McClenathan | 242/56 A |

FOREIGN PATENT DOCUMENTS

| | | | |
|---|---|---|---|
| 2203696 | 8/1973 | Fed. Rep. of Germany | 242/56 A |
| 57847 | 4/1984 | Japan | 242/56 A |

*Primary Examiner*—John M. Jillions
*Attorney, Agent, or Firm*—Robert Stenzel

[57] ABSTRACT

An improved rider roll assembly and winder, especially adapted for use on turret winders in the winding of sheet materials. The rider roll assemblies on the turret arms are mounted on the same axis as the winding rolls. The angular position of a rider roll may be controlled by control means such as a programmable controller operating through connecting linkages.

37 Claims, 5 Drawing Sheets

WINDER RIDER ROLL

BACKGROUND OF THE INVENTION

This invention pertains to winders for winding, onto a roll, sheet materials such as paper, plastics, metal foil, composites, and the like. Such winders are used for winding up sheet materials after they are made, such as at the end of a paper making machine or at the end of a plastics film extrusion operation. They are also used to wind up sheet materials after other processing operations, such as the various converting operations which are commonly performed on sheet materials.

In conventional use, a winder is positioned at the end of the processing line, and is used to wind up the sheet material in roll form, typically on a pre-formed roll core. It is believed that the sheet material approaching the roll carries with it a boundary layer of air. As sheet material is wound onto the roll, the boundary layer air tends to stay with it, and may serve as a pseudo-pneumatic air foil layer between adjacent layers of sheet material in the roll. This air foil may contribute to loosening or shifting of the layers relative to each other, which may make the roll hard to handle, or may make it susceptible to shipping damage; or the useful and undamaged width may be reduced unacceptably.

It has been found desirable, in conventional practice, to apply pressure to the outside of the winding roll as it is being wound up, to force dissipation of the boundary layer, so that the layers in the roll will have substantial sheet-to-sheet contact, and thus stabilize relative to each other and reduce loosening or shifting of the layers. The typical method of applying pressure is by means of a rider roll which rides on the outside surface of the main winding roll.

Turret winders are especially desirable for use with essentially continuous high speed sheet material-producing operations. For example, paper making machines may produce paper at a rate of 3000 feet per minute, or more. When a roll on a winder is full, the paper making machine continues to produce paper while the full roll is being replaced by a new and empty roll with a core in place. Thus it is important that the incoming paper be transferred quickly to the new and empty roll. Turret winders have been found useful to meet these requirements. Where used with turret winders, rider rolls have been mounted on each of the turret arms between the winding roll axis and the main axis about which the turret rotates.

The rider roll is generally positioned on the winding roll in such a location that the sheet comes under the pressure of the rider roll at about the same time that the sheet enters the roll, which may be at its point of tangency with the roll. In such a case, the sheet material is tangent to both the winding roll and the rider roll at essentially the same points. As the roll fills with the sheet material, the angular point of contact between the rider roll and the winding roll changes somewhat, for example clockwise, while the point of tangency between the winding roll and the sheet material may change in the opposite direction, for example counterclockwise. This shift may, in some operations, allow some of the boundary layer air to remain between the incoming layer and the adjacent inner layer, where the pressure is applied by the rider roll at a point after the point of tangency between the roll and the sheet material.

A more serious problem occurs when the winding roll is full and is rotated about the turret axis, such as 180 degrees to bring an empty roll into position. During the rotation of the turret, the winding roll continues to wind. In the process of the rotation, the rider roll rotates with the turret arm to which it is mounted. On a conventional two roll turret, where rotation of about 180 degrees is normal, the rider roll remains at about the same relative position on the winding roll while the point of tangency of the incoming sheet shifts with the rotation of the winding roll—about 180 degrees. Thus, after rotation of the turret, the sheet material is not pressed against the winding roll until it has traversed a 180 degree arc on the winding roll.

Another affect of the turret rotation is that a rider roll which has been on top of the winding roll is then below the winding roll, and its gravitational weight is no longer contributing to the applied pressure, but is, rather, working against it. Thus, the effective pressure applied may change.

In some cases, it may be desirable to continue winding temporarily on the full roll after rotation of the turret, such as to give time to complete a set-up operation or to correct a mechanical defect.

Any sheet material so wound, with the rider roll thus out of position relative to the point of tangency of the incoming sheet with the roll, is highly subject to the aforementioned shifting and loosening as when no rider roll is used.

It would be desirable to provide a rider roll mechanism wherein the rider roll would remain at the point of tangency between the sheet and the winding roll throughout the winding cycle; or at least the rider roll would remain at the point where the sheet material enters the winding roll.

It is an object of this invention to provide a rider roll assembly which may be mounted on a winder, and which may be controlled to stay at the point of tangency during winding, and may revolve about the winding roll, such as for loading and unloading operations.

It is another object to provide a winding assembly, including a rider roll mounted on the assembly in such a way that the position of the rider roll, in angular relation to the winding roll, may be readily changed, or adjusted.

Another object of the invention is to provide a rider roll assembly which may be mounted on a winder, and which may be controlled to be at the point where the sheet material enters the winding roll.

SUMMARY OF THE INVENTION

These and other objectives are seen to be obtained in an improved winder for winding sheet material onto a roll. The winder includes a winding roll which has capability of rotation about a first axis, responsive to a winding roll drive. The winder includes, in addition to the winding roll, a rider roll assembly. The primary component of the rider roll assembly is a rider roll which rotates about a second axis which is different from the first axis. The rider roll rides on the winding roll and is capable of revolving about the winding roll.

Preferably the rider roll is attached to a pair of rider assembly arms which are mounted to the first axis and are capable of revolution about the first axis. The rider roll assembly further includes a control means for controlling the rider roll assembly. Preferably a programmable controller controls the location of the second axis relative to the location of the first axis such that a plane passing through the first and second axes at one point in time is essentially parallel to a plane passing through both those axes at another point in time during the winding of the sheet material, in typical operations, particularly during winding, and during rotation of the turret.

Rider assembly arms which connect the rider roll to the first axis, on each end of the rider roll, are typically jointed, or segmented. A pneumatic cylinder, or similar control device, extends between either the first axis and the rider roll, or their equivalents, or between arm segments, and is capable of controlling the amount of pressure which the rider roll exerts on the winding roll.

It is believed that this invention has substantial application for use in turret winders where a plurality of winding rolls is mounted in turret style, on a base which allows for the rotation of a plurality of winding rolls about a third central turret axis, thus to present an empty roll to a processing line for immediate transfer of the sheet material to the empty roll when a roll is filled. A turret winder, of course, has pairs of turret arms which rotate about the third turret axis. The turret winder typically has a drive for rotating the turret arms about that third axis. Typically there is a separate drive for each winder, a separate controller for each rider roll and finally a drive for the turret arms themselves for rotating the arms about the third turret axis.

The invention further contemplates methods of winding sheet material onto a winding roll. The method includes the step of driving the winding roll, and the step of pressing a rider roll against the winding roll at points where the incoming sheet is essentially tangent to the winding roll. Another optional step is adjusting the rider roll position for shifting points of tangency. A further step in the process is rotation of the turret arm while controlling, or maintaining, the angular position of the rider roll relative to a plane containing the winding roll axis; especially during rotation of the turret arms with concurrent winding of the sheet. A further and optional step in the method is the step of revolving the rider roll about the winding roll axis. Further steps in a preferred method include predetermining desired revolution of the rider roll about the winding roll and inputting the pre-determined movements into a programmable controller connected to the winder, such that the desired movements are effected by the programmable controller.

DETAILED DESCRIPTION OF THE PREFERRED EMBODIMENTS

Figure 1:
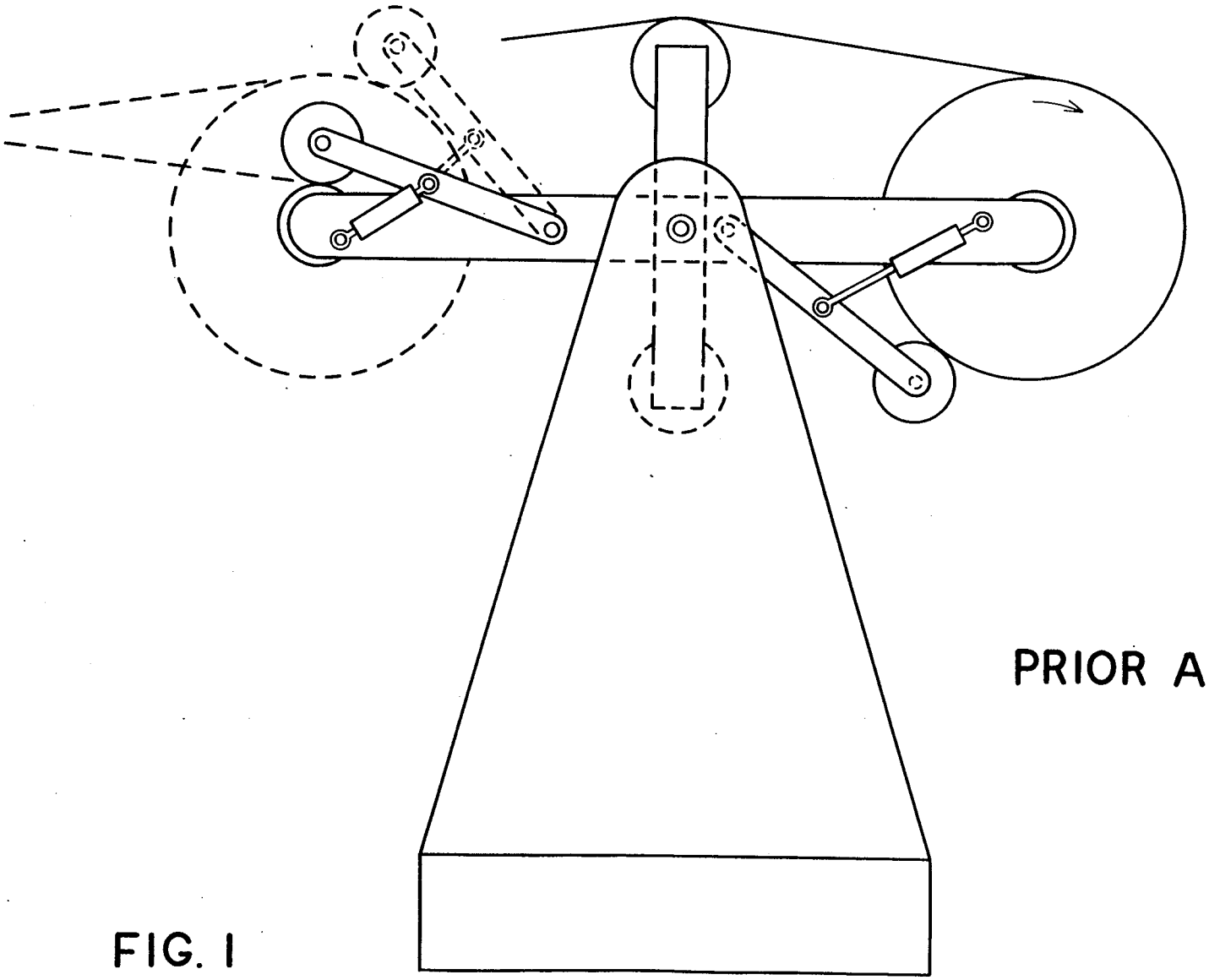
PRIOR ART FIG. 1
FIG. 1 is a side view of a prior art turret winder using conventional rider rolls which are conventionally mounted.

Turning now to FIG. 1, which shows a prior art turret winder, there is seen a winder having two pairs of turret arms, each of which holds a core for winding a roll. The drawing shows a situation where a roll has been filled and the turret has been rotated preparatory to the transfer of the incoming sheet material to the empty winding roll, which is now on the left turret arm. Rider rolls are seen attached to both turret arms between the respective winding rolls and the turret axis at the turret frame. The rider roll rides on the winding roll and desirably exerts a pressure at the outer layer of sheet material which is being wound onto the winding roll. The rider roll on the empty winding roll rides on the top of the winding roll, or the roll core, as shown, with the rider roll riding the winding roll at essentially the point where sheet material would be tangent to the winding roll, the sheet being shown as a dashed line. It is seen in the phantom outline of the full roll on the left arm, that the rider roll has moved somewhat away from the point of tangency in the process of the roll being filled with the sheet material. Indeed, FIG. 1 shows that the point of tangency between the sheet and the filled roll has shifted counterclockwise, relative to the point of tangency on the unfilled roll. The points of contact between the rider roll and the roll being wound have shifted clockwise. As a result, sheet may enter the roll at a locus substantially spaced from the rider roll, and thus may not gain the full stabilizing benefit of the rider roll.

On the right turret arm, where the full roll is still winding the sheet material, it is seen that the rider roll is displaced from the point of tangency of the incoming sheet material by approximately 180 degrees. This is caused by the rotation of the turret arms, and the fixed mounting of the rider roll assembly, such that the rider roll is placed below the winding roll in a position displaced from the point of tangency of the incoming sheet material of approximately 180 degrees.

It is further seen that the weight of the rider roll can contribute to the pressure it exerts on the winding roll on the left turret arm; whereas the rider roll on the right turret arm at any given time is being held to the winding roll only by the controlling cylinder which connects the rider roll arm to the turret arm. Thus it may be desirable, in conventional winders, to compensate the controlling cylinder for the gravitational force of the rider roll in order to maintain uniform pressure of the rider roll on the winding roll at all times. The rider roll on the right arm, however, is, as shown, located approximately 180 degrees out of synchronization with the tangency of the incoming sheet material. As such, the positioning of the sheet material is not assuredly controlled, and a sideways shifting of the sheet may result, with attendant unevenness of the wound roll.

Figure 2:
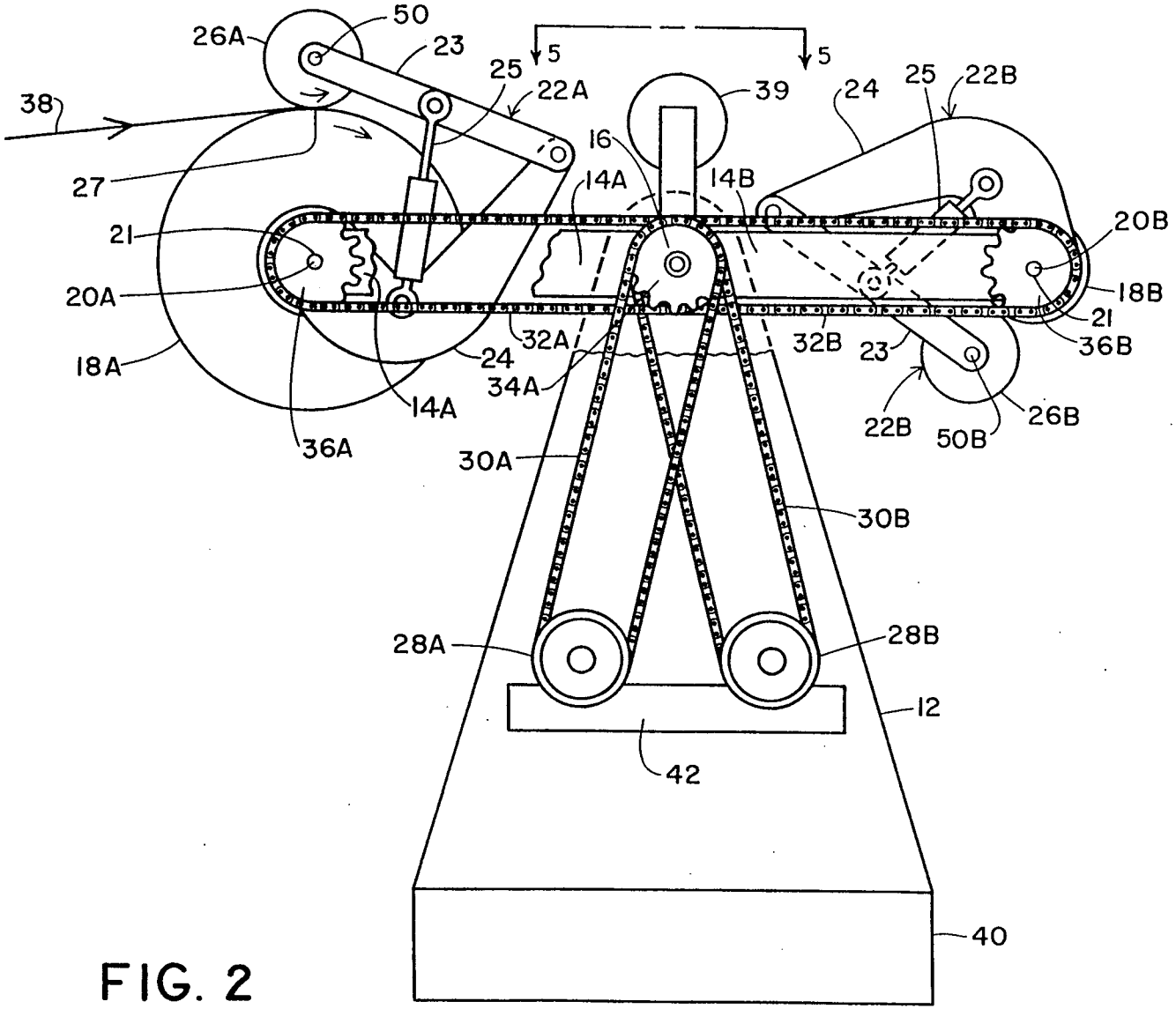
FIG. 2 is a side view of a turret winder of the invention with part of a turret arm and the base cut away to show portions of the rider roll assembly of the invention and its drive, and showing a sheet material being wound onto an essentially filled roll.
Figure 3:
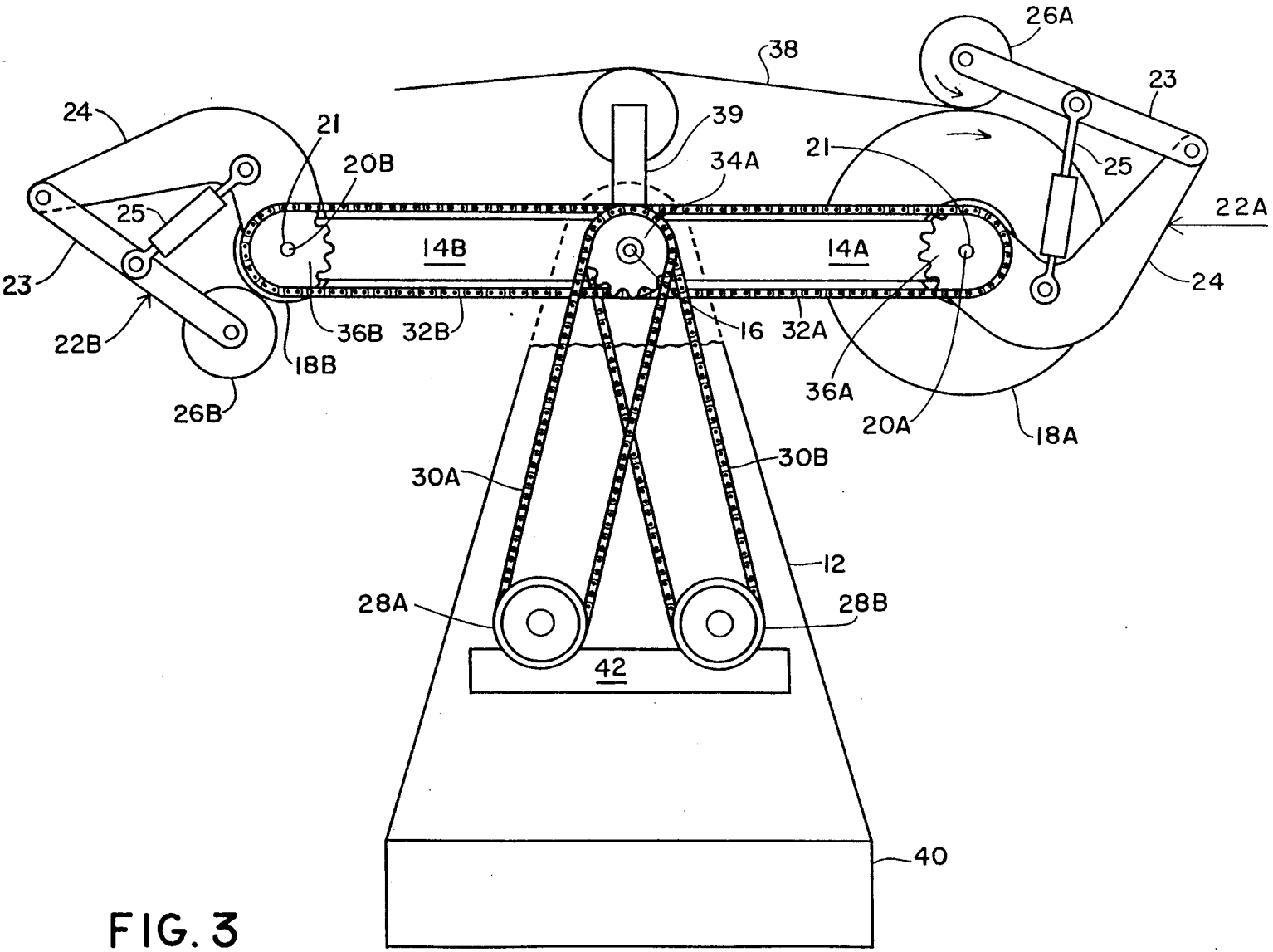
FIG. 3 shows the turret winder of FIG. 2 with the turret having been rotated 180 degrees in preparation for the transfer of the sheet to the new and empty roll.

Turning now to the invention, there is seen in FIG. 2 a turret winder incorporating the improvements of the invention therein. The turret winder includes a frame 12 to which are mounted two pairs of turret arms 14A and 14B which rotate about a central turret axis 16. Near the ends of the pairs of turret arms are mounted winding rolls 18A and 18B on second axes 20A and 20B. Rider roll assemblies 22A and 22B are mounted to pivot member 21 about the same respective axes 20A and 20B. The rider roll assembly includes two segmented rider assembly arms 23 and 24 in each of the assemblies and a rider roll 26 designated 26A and 26B in the right and left assemblies, respectively, as seen in FIG. 3. A pressurized cylinder 25 extends between the respective rider arm segments 24 and urges the rider roll 26 against the winding roll 18 designated 18A and 18B in the right and left assemblies, respectively, as seen in FIG. 3, on its outer periphery, thus applying a constant pressure to the winding roll during the winding operation; preferably at the locus 27 where the incoming sheet material is tangent to the winding surface of the winding roll, and encounters the winding roll and the rider roll essentially simultaneously at essentially the point of tangency, as at roll 18A in FIG. 2. Cylinder 25 is preferably pneumatic, but may also, in some cases, be hydraulic.

The rider roll assembly 22A is positioned angularly about axis 20A and winding roll 18A by means of controller 28A and connecting chains 30A and 32A through sprocket 34A. Sprocket drives, as at 30A and 32A, for the rider roll assembly may drive on only one side of the turret, as shown, or may drive on both sides of the turret winder. For driving both sides, a connecting means, such as a shaft, extends from the controller side of the winder to the main winder drive side. Chain 30A is connected to controller 28A directly and to sprocket 34A. Chain 32A is connected to a sprocket which is slave driven by sprocket 34A and is also connected to sprocket 36A through a concentric shaft. Arm segments 24 are connected to sprocket 36A, such that driving of chains 30A and 32A by virtue of the connecting sprockets is effective to drive the rider roll assembly and cause it to revolve around axis 20 designated 20A and 20B in the right and left assemblies, respectively, as seen in FIG. 3. Such a revolvement is seen to have taken place in rider roll assembly 22B in FIG. 2.

Turning now to FIG. 3 it is seen that the turret has rotated such that roll 18A is on the right side of the turret. Roll 18A is still the roll to which the sheet material 38 is being wound. It is seen that the rider roll 26A is still at the locus of tangency between sheet 38 and winding roll 18A. This is accomplished in two ways. The primary means of keeping rider roll 26A on top of winding roll 18A is by holding drive chain 30A essentially stationary while the turret is being rotated. With drive chain 30A held essentially stationary, rider roll 26A is maintained in its basic angular position relative to a horizontal plane during the rotation of the turret. Minor adjustments to the position of the rider roll are required by, for example, the change in the angle of the incoming sheet 38 as effected by control idler 39. These adjustments are made by minor control movements driven by controller 28A through chains 30A and 32A and the associated sprockets. Thus, while the basic structural layout of the chain drive serves to generally position the rider roll 26A at the same location throughout any rotation of the turret, minor adjustments to the basic control are made through the controller 28A, which is preferably a programmable controller.

Maintaining the primary positioning of the rider roll on top of the winding roll during rotation of the turret effectively comprises revolving the rider roll about the winding roll axis by the number of degrees of rotation of the turret arms about the turret axis 16. The minor adjustments to the rider roll positioning, whether during the primary winding as in FIG. 2 or after the rotation as in FIG. 3, also comprise revolving the rider roll about the winding roll. Similarly, the movement of the rider roll to a position more or less below the winding roll, as to facilitate removal of a full roll, and as seen in FIG. 2, comprises revolving the rider roll about the winding roll.

Figure 4:
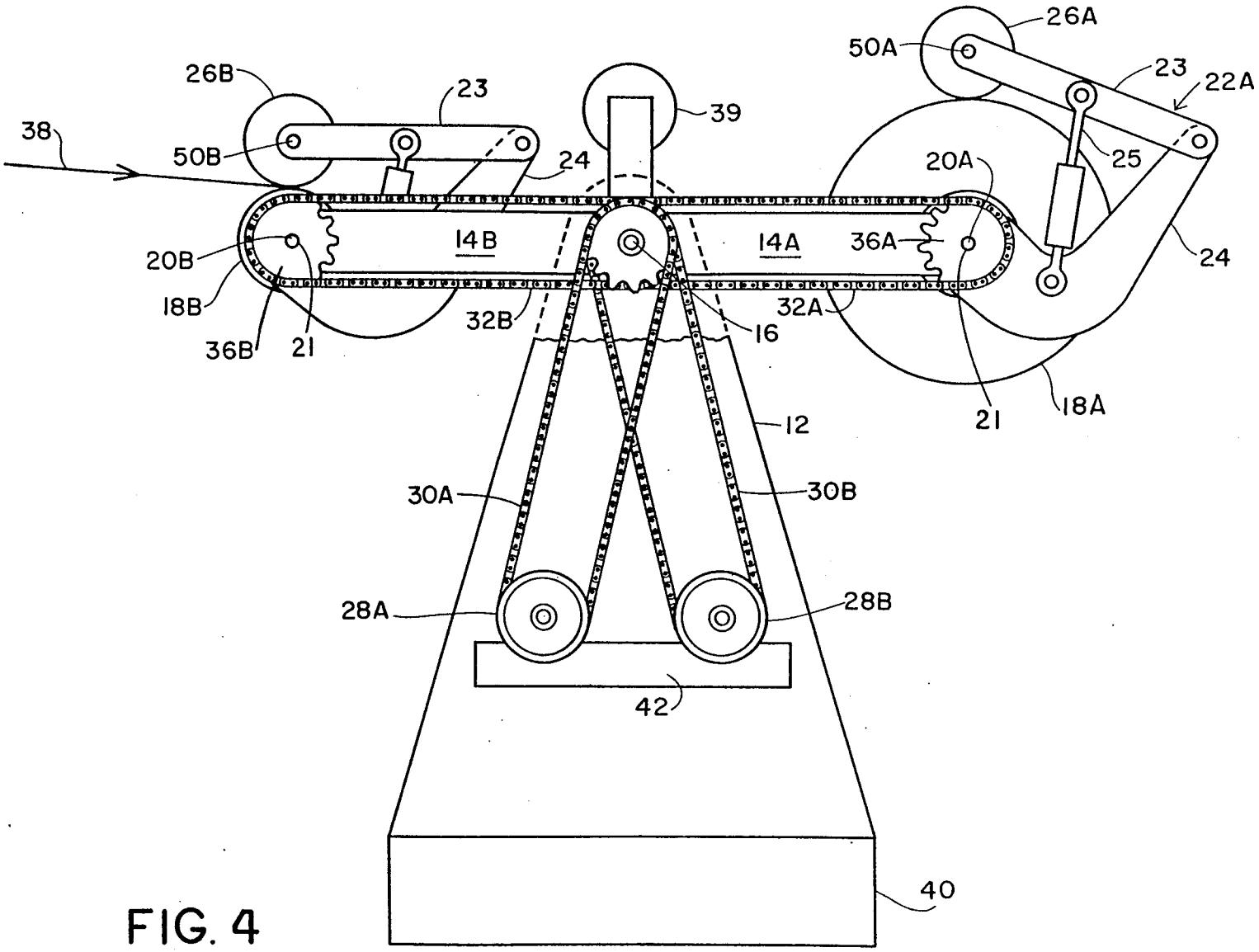
FIG. 4 shows the turret winder as in FIGS. 2 and 3 with the incoming sheet material having been transferred to the empty roll.

As seen in FIGS. 2–4, the distance between the rider roll 26 and the axis 20 about which the rider is mounted, and about which it revolves is constant during any particular short term revolving of the rider roll about axis 20. The gradual angular adjustments to the position of rider roll 26, over an extended period of time, namely the term for winding a full roll 18, are, of course, accompanied by the normal changes in diameter of roll 18, and thus changes in distance between rider roll 26 and axis 20. Nonetheless, as is seen in the drawings, incremental changes in the angular positioning of the rider roll with respect to axis 20 do not cause a simultaneous change in distance between rider roll 26 and the axis 20 about which it revolves. Such changes are, rather, seen to be a function of the diameter of roll 18, not of angular positioning of the rider roll 26.

The transfer of the incoming sheet 38 from the full roll 18A to the empty roll 18B is made by conventional and well known methods. Once the transfer has been made, the operation looks much like that shown in FIG. 4. As seen in FIG. 4, the sheet 38 has been transferred to the new and empty roll 18B. Turret arm 14A is subsequently prepared for removal of the full roll therefrom. In the preparation for removing the full roll 18A from turret arm 14A the rider roll assembly 22A may be revolved approximately 180 degrees about axis 20A as seen with rider roll assembly 22B in FIG. 2. Once the rider roll assembly has been revolved, the winding roll 18A is readily removed. Once roll 18A has been removed, the new core may be installed, and the winder is then ready for the next rotation.

Figure 5:
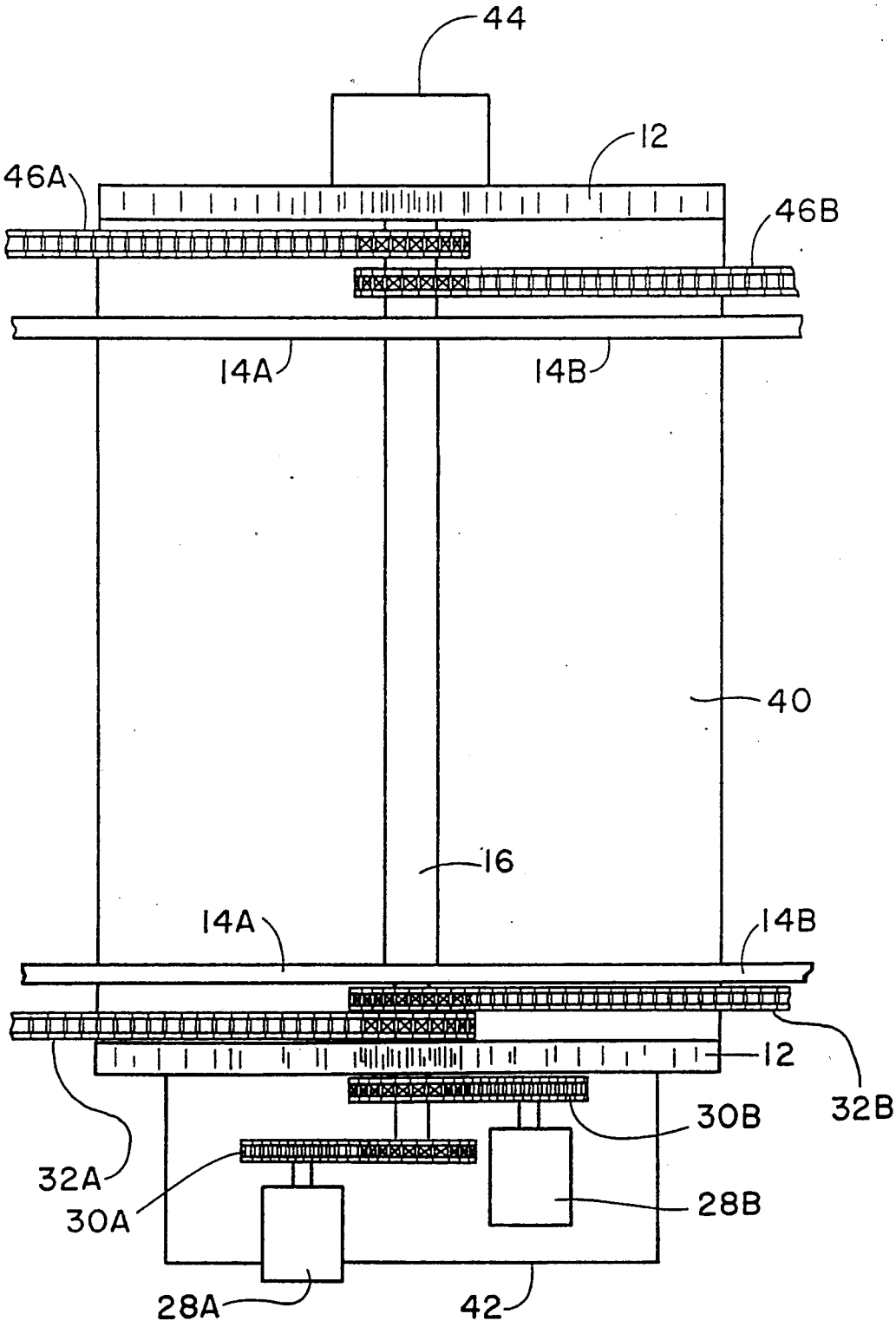
FIG. 5 is a top view taken at 5—5 of FIG. 2 and showing a top view of the center portion of the turret winder, and including the main winder drives, and the programmable controllers, but not the control idlers.

FIG. 5 shows a top view of the central portion of the turret winder of FIG. 2, but without showing, for clarity, the conventional control idler and arm subassembly 39. There is seen frame members 12 mounted to a base 40. Programmable controllers 28A and 28B are also mounted to frame 12 by a bracket 42. The main winder drives 44 are likewise mounted to the frame 12 preferably on the other side of the frame-base combination. Chains 46A and 46B represent conventional linkage between the main winder drives 44 and the winding rolls 18A and 18B.

The term winding roll, as used herein, refers to both the roll of sheet material and the core on which it is wound. Further it refers as appropriate to axes 20A and 20B to which the cores are mounted. The sheet material 38 is, of course, attached by adhesive or other suitable means to the core at the time winding is begun.

The description herein has basically described the operation of one side of the turret, namely that being the winding roll 18A. Winding roll 18B operates in essentially the same manner, with rolls 18A and 18B taking turns being the winding roll and the roll in waiting. Additional winding rolls may be incorporated into the turret assembly as desired.

The rotation of the turret is accomplished by a conventional turret drive which is not shown for simplicity of the drawings.

Returning now to the operation of the rider roll as it is controlled by a programmable controller, it is seen that by holding the chain 30A motionless as the turret arms 14A and 14B are rotated, rider roll 26A is maintained by virtue of chain position, on essentially the top of the winding roll 18A as the turret is rotated. Thus an imaginary plane passing through axis 20A of the turret arm (which is the axis of rotation of a respective winding roll being wound) and axis 50A of rider roll 26A, in FIG. 2, is approximately parallel to a plane passing through the same axes in FIGS. 3 and 4. Further at any point in the rotation of turret arms 14A and 14B about axis 16, if chains 30A and 30B remain essentially motionless during the rotation, then 26A and 26B will maintain such an angular position relative to the respective winding rolls that planes passing through axes 20A and 50A at any point in the rotation will be parallel to all other planes passing through the same axes at other points in the rotation. A similar relationship likewise exists between axes 20B and 50B. Adjustments of the rider roll position, and revolving of the rider roll 26 about winding roll 18, are desirable from time to time, such as to adjust for shift in point of tangency, as to maintain the rider roll at the point of tangency during the winding operation, as illustrated in FIGS. 2 and 4, or to move the rider roll to facilitate removing a full roll or otherwise servicing the winder. Such adjustments and movement may be programmed into the programmable controllers 28 designated 28A and 28B on the left and right sides of the winder base, respectively, as seen in FIG. 3. The controllers may also be used for unprogrammed movements by use of conventional unprogrammed control drivers on the controllers.

Chains 32, designated 32A and 32B with respect to controlling the right and left assemblies, respectively, as seen in FIG. 3, could be mounted as to fixed, and essentially immoveable, or manually moveable sprockets, rather than using a programmable controller. In these embodiments, the angular positions of rider rolls remain constant until the sprockets are manually moved, as by a wheel or lever. The sprockets or chains can, of course, be locked against movement, by conventional lock means.

In use of the turret winders of the invention, cores are mounted on the winding roll axes 20A and 20B. The rider roll on the axis to be used first is generally positioned in the unload position, away from the point of tangency of the sheet on the core until the sheet is secured to the core, at which time it is positioned on the top of the winding roll as seen at 26B in FIG. 4. Typically the rider roll on the opposite arm will be in the unload position as seen at 26B in FIG. 2. Sheet material is wound onto the winding roll, which has the rider roll on top. The rider roll position is adjusted with the shift in the point of tangency as the winding roll fills. When the roll is essentially full, The turret is rotated about the turret axis 16 to a position seen in FIG. 3, where the full roll is positioned away from the incoming source of sheet material, with the rider roll 26A still on top of the winding roll 18A, pressing and consolidating the sheet material onto the winding roll at essentially its point of tangency with the winding roll.

As seen by comparing FIGS. 2 and 3, the rider roll 26 is the same distance from the axis 20, about which it revolves, both before and after rotation of the turret arms 14.

Also, as seen in FIGS. 2, 3, and 4, the rider roll 26 is the first roll to engage the incoming sheet material against winding roll 18 both during primary winding as at FIGS. 2 and 4, and during rotation of the turret arms as seen in FIG. 3.

The incoming sheet material 38 is transferred to the empty winding roll 18B. As soon as the transfer is established, the rider roll 26B may be revolved to the point of tangency of the incoming sheet material with the winding roll, as seen at roll 18B in FIG. 4. Likewise referring to FIG. 4, wherein the full roll needs to be removed from the turret, the rider roll assembly 22A is revolved 180 degrees, more or less, about axis 20A, to provide clear access to the roll 18A for unloading.

The composite rider roll pressure is the sum of the rider roll weight on the winding roll 18 plus the pressure applied by cylinder 25. With the rider roll 26 being maintained on top of the winding roll 18 during and after rotation of the turret arms 14, until winding on the respective winding roll 18 is terminated, the weight of the rider roll on winding roll 18 is essentially constant. Thus, the composite pressure of rider roll 26 on winding roll 18 may be held essentially constant during the winding operation, both before, during and after rotation of the turret arms, as at FIGS. 2 and 3, by applying a constant force at cylinder 25.

As seen in FIGS. 2–4, the directional nature of the force applied by cylinder 25 is such that the force is directed generally parallel to a line between, for example, axis 20A of rotation of winding roll 18A and axis 50A of rotation of rider roll 26A. So the force of cylinder 25 is acting in a direction which is generally perpendicular to the surface of the winding roll 18A at the locus where the force is applied by rider roll 26A. With the rider roll arms 24 being mounted about the same axis 20A as is winding roll 18A, the application of force by cylinder 25 applies equal forces to axes 20A and 50A, such that the action of applying force on rider roll 26A by means of cylinder 25 applies an equal and opposite force on axis 20A, according to conventional laws of physics. The applied forces thus tend to draw axes 20A and 50A together.

Cylinder 25 may, of course, be attached at alternate attachment points, so long as the result is the applying, by the cylinder, of a force between the rider roll and the axis 20 of the winding roll.

Thus it is seen that the invention provides improved rider roll mechanism where the rider roll remains at essentially the point of tangency between the sheet and the winding roll throughout the winding cycle, including that period in time where the winding roll may be rotated about a turret base to rotate a new, or empty, winding roll into position for transfer of the incoming sheet material thereto. It is further seen that the invention provides the capability to make minor adjustments to the position of the rider roll. It further provides the capability for the rider roll to be moved out of the way for the removal of the wound roll from the winder.

It is further seen that the angular position of the rider roll relative to the winding roll can be controlled and changed according to the control provided by controllers, preferably by programmable controllers which are attached, through linkage means, to the rider roll assembly. Thus, the positioning of the rider roll at any point in the winding process, including loading the core and unloading the finished roll, may be pre-determined and programmed into the appropriate controllers, such that the positioning of the rider roll is automatically controlled by the appropriate controller during the winding process. Conventional provision is normally made, of course, for any necessary manual override of the automatic controls.

Having thus described the invention, what is claimed is:

1. A rider roll assembly, comprising:

(a) a rider roll;

(b) means rotatably mounting said rider roll for rotation about its own first axis of rotation;

(c) jointed arms having first and second arm segments, said first arm segment being attached to said rider roll about said first axis of rotation, and said second arm segment being rotatably mountable to a winder roll at its own second winder roll axis of rotation, such that said arm segments, and thus said rider roll assembly, can be rotated with respect to the winder roll; and (d) control means for controlling rotations of said assembly about the winder roll.

2. A turret winder assembly, said assembly comprising:

(a) a frame;

(b) turret arms mounted to said frame and rotational about a first axis in said frame;

(c) means for rotating said turret arms about said first axis;

(d) a winding roll for sheet material rotatably mounted on said turret arms, for rotation about its own second winding roll axis;

(e) means for rotatably driving said winding roll and thereby winding said sheet material onto said winding roll;

(f) a rider roll assembly rotatably mounted to said turret arms at said second axis, for rotation of said rider roll assembly about said second axis, said rider roll assembly including a rider roll rotatably mounted for rotation about its own third axis of rotation and riding on said winding roll;

rotation of said turret arms about said first axis being functional to position said winding roll in positions disposed toward said incoming sheet material;

said turret winder assembly comprising means for adjusting the position of said rider roll on said winding roll to stay during winding essentially at that point of tangency between said incoming sheet material and said winding roll which will exist in the absence of said rider roll.

3. A winder for winding a sheet material onto a roll, said winder comprising:

(a) means for winding a sheet material onto a winding roll having a first axis, said winding roll being driven by a winding drive;

(b) means for pressing a rider roll against said sheet material such that said incoming sheet material encounters said winding roll and said rider roll at essentially that locus of tangency between the winding surface of said winding roll and said incoming sheet material which would exist in the absence of said rider roll; and (c) means for revolving said rider roll about said winding roll, said winder being a turret winder having turret arms, said winding roll being mounted on said turret arms, said rider roll being mounted to said winder by mounting means, and including means for rotating said turret arms while revolving the angular position of said rider roll about said mounting means such that said rider roll is maintained in position at essentially said locus of tangency.

4. A method of winding sheet material onto a roll on a turret winder having at least one pair of turret arms rotatably mounted on a frame, said method comprising the steps of:

(a) winding said sheet material onto a winding roll having a first axis of rotation and being mounted on said pair of said turret arms, said winding roll being rotated about said first axis of rotation by a winding drive;

(b) pressing a rider roll having a second axis of rotation against said winding roll at approximately the location where said sheet material enters said roll; and (c) rotating said turret arms with respect to said frame while operating control means to thereby maintain the angular position of said rider roll on said winding roll relative to a horizontal plane.

5. A method as in claim 4 and including the step, while said turret arms are not rotating, of revolving said rider roll about said first axis, while maintaining a constant distance between said rider roll and said first axis.

6. A winder for winding sheet material, said winder comprising:

(a) a winding roll, and means for rotatably mounting said winding roll about its own first axis of rotation, and about which winding roll sheet material can be wound;

(b) means for driving said winding roll and thereby winding said sheet material onto said winding roll;

(c) a rider roll assembly rotatably mounted, at a locus, to said winder for rotation about said locus, said rider roll assembly including a rider roll riding on said winding roll; and (d) control means for controlling arcuate movement of said rider roll about the surface of said winding roll while maintaining a constant distance between said rider roll and said locus of mounting said rider roll assembly.

7. A winder as in claim 6 and including means for generating a force for pressing said rider roll against said winding roll at a locus of contact, said force generating means being capable of generating a force acting in a direction generally perpendicular to said winding roll at said locus of contact, at all stages of winding.

8. A turret winder assembly for winding an incoming sheet material onto rolls, said assembly comprising:

(a) a frame;

(b) turret arms mounted to said frame and rotational about a first axis in said frame;

(c) means for rotating said turret arms about said first axis;

(d) a winding roll rotatably mounted on said turret arms, for rotation about its own second winding roll axis;

(e) means for rotatably driving said winding roll and thereby winding said sheet material onto said winding roll; and (f) a rider roll mounted in said assembly for revolution about said second axis, said rider roll functioning as the first roll to engage the incoming sheet material against said winding roll, at approximately the point where said sheet material enters said roll being wound, said rider roll providing (i) said first engagement function and (ii) engagement at approximately the point where said sheet material enters said roll, both during the primary winding of said winding roll and during rotation of said turret arms about said first axis.

9. A turret winder assembly as in claim 8 and including means for generating a force for pressing said rider roll against said winding roll at a locus of contact, said force generating means being capable of generating a force acting in a direction generally perpendicular to said winding roll at said locus of contact.

10. A winder for winding sheet material onto a roll, said winder comprising:

(a) a winding roll, and means for rotatably mounting said winding roll about its own first axis of rotation, and about which winding roll said sheet material can be wound;

(b) means for driving said winding roll and thereby winding said sheet material onto said winding roll; and (c) a rider roll assembly, including a rider roll, said rider roll riding on said winding roll, said rider roll being mounted for rotation about its own second axis of rotation, said rider roll being attached to an arm, said arm being mounted for rotation about said first axis of said winding roll.

11. A winder as in claim 10, said winder including control means for controlling revolution of said rider roll about said first axis of said winding roll, said winding roll being rotatably mounted on turret arms at said first axis, said turret arms being rotatably mounted to a winder frame at a third axis, and including means for rotating said turret arms, and thus said winding roll, about said third axis, said control means including means for maintaining said second axis, during a rotation of said turret arms, and thus said winding roll, about said third axis, in a moving plane also containing said first axis, said moving plane containing said first and second axes during rotation of said turret arms being approximately parallel to a plane containing both said first and second axes before the beginning of said rotation.

12. A winder as in claim 10, said rider roll being attached to said arm, said arm being mounted for rotation about said first axis, said arm comprising arm segments, and including means, attached to at least one of said arm segments, for applying a non-gravitational force between said rider roll and said first axis.

13. A winder as in claim 12, and including control means for controlling revolution of said rider roll about said first axis of said winding roll.

14. A winder as in claim 10, and including control means for controlling revolution of said rider roll about said first axis of said winding roll.

15. A winder as in claim 10 and including means for generating a force for pressing said rider roll against said winding roll at a locus of contact, said force generating means being capable of generating a force acting in a direction generally perpendicular to said winding roll at said locus of contact.

16. A turret winder assembly for winding sheet material onto rolls, said assembly comprising:

(a) a frame;

(b) turret arms mounted to said frame and rotational about a first axis in a said frame;

(c) means for rotating said turret arms about said first axis;

(d) at least one winding roll rotatably mounted on said turret arms, for rotation about its own second winding roll axis of rotation;

(e) means for rotatably driving said winding roll and thereby winding said sheet material onto said winding roll; and (f) a rider roll assembly rotatably mounted to said turret arms at said second axis, for rotation of said assembly about said second axis, said rider roll assembly including a rider roll rotatably mounted for rotation about its own third axis of rotation and riding on said winding roll.

17. A turret winder assembly as in caim 16, said rider roll being attached to a pair of arms, said arms being mounted for rotation about said second axis, said arms comprising arm segments and including means, attached to at least two of said arm segments on said rider roll assembly, for applying a force tending to change the distance between portions of said two arm segments.

18. A turret winder assembly as in claim 16 and including control means for controlling revolution of said rider roll about said winding roll.

19. A turret winder assembly as in claim 18, said rider roll being attached to a pair of arms, said arms being mounted for rotation about said second axis, said arms comprising arm segments and including means, attached to at least two of said arm segments on said rider roll assembly, for applying a force tending to change the distance between portions of said two arm segments.

20. A turret winder assembly as in claim 19, said control means comprising means for maintaining said third axis of said rider roll on said turret arm, during a rotation of said turret arm about said first axis, in a moving plane also containing said second axis, said moving plane containing said second and third axes during rotation of said turret arms being approximately parallel to a plane containing said second and third axes before the beginning of said rotation.

21. A turret winder assembly as in claim 20 and including means for revolving said rider roll about said winding roll.

22. A turret winder as in claim 20 wherein said control means includes a programmable controller.

23. A turret winder assembly as in claim 18 and including means for pressing said rider roll against said winding roll in a direction generally passing through said second and third axes.

24. A turret winder assembly as in claim 16 and including means for pressing said rider roll against said winding roll in a direction generally passing through said second and third axes.

25. A turret winder assembly as in claim 16, said rider roll being attached to an arm, said arm being mounted for rotation about said second axis, said arm comprising arm segments, and including means, attached to at least one of said arm segments, for applying a non-gravitational force between said rider roll and said first axis.

26. A turret winder assembly as in claim 16 and including means for revolving said rider roll about said winding roll.

27. A turret winder assembly as in claim 16 and including means for generating a force for pressing said rider roll against said winding roll at a locus of contact, said force generating means being capable of generating a force acting in a direction generally perpendicular to said winding roll at said locus of contact.

28. A method of winding an incoming sheet material onto a roll on a turret winder having turret arms, said method comprising the steps of:

(a) winding said sheet material onto a winding roll having a first axis of rotation and being mounted to two of said turret arms, said winding roll being rotated about said first axis of rotation by a winding drive;

(b) pressing a rider roll having a second axis of rotation against said winding roll at approximately the location where said sheet material enters said roll; and (c) during the winding of said sheet material onto said winding roll, and with said turret arms stationary, (i) making a determination that said rider roll should be moved on said winding roll, angularly about said first axis, and (ii) angularly moving said rider roll on said winding roll and about said first axis.

29. A method as in claim 28 wherein said determination, as to time, direction, and amount of said movement is made before commencement of winding said sheet material onto said winding roll, wherein said determination is inputted to a programmable controller, and wherein said movement is effected by said programmable controller according to said input.

30. A method of winding an incoming sheet material onto a roll on a turret winder having turret arms, said method comprising the steps of:

(a) winding said sheet material onto a winding roll having a first axis of rotation and being mounted on one of said turret arms, said winding roll being rotated about said first axis of rotation by a winding drive;

(b) pressing a rider roll having a second axis of rotation against said winding roll at approximately the location where said sheet material enters said roll;

(c) making a determination that said rider roll should be moved on said winding roll, angularly about said first axis; and (d) angularly moving said rider roll on said winding roll and about said first axis, wherein said moving is effective to position said rider roll such that said incoming sheet material encounters said winding roll and said rider roll essentially simultaneously at essentially the locus of tangency between the winding surface of said winding roll and said incoming sheet material.

31. A method as in claim 30 wherein said determination, as to time, direction and amount of said movement is made before commencement of winding of said sheet material onto said winding roll, wherein said determination is inputted into a programmable controller, and wherein said movement is effected by said programmable controller according to said input.

32. A method of winding sheet material onto a roll, said method comprising:

(a) winding an incoming sheet material onto said winding roll on a turret winder, said winding roll having an axis of rotation;

(b) pressing a rider roll against said winding roll, said rider roll being attached to an arm, said arm being rotatably mounted for rotation about said axis of rotation; and (c) arcuately moving said rider roll about the surface of said winding roll while maintaining a constant distance between said rider roll and said axis of rotation.

33. A method as in claim 32, said winder having a plurality of turret arms rotatably mounted to a frame, and including maintaining a constant distance between said rider roll and said axis during rotation of said turret arms about said frame.

34. A method of winding an incoming sheet material onto a roll on a turret winder having turret arms rotatably mounted on a frame, and a winding roll rotatably mounted on said turret arms, said turret arms being functional for positioning said winding roll toward said incoming sheet material, and for positioning said winding roll away from said incoming sheet material, said turret winder comprising a rider roll on said winding roll, said method comprising the steps of:

(a) positioning said winding roll toward said incoming sheet material, winding said sheet material onto said winding roll, and positioning a rotatably mounted rider roll on said winding roll at essentially the point of tangency between said incoming sheet material and said winding roll; and (b) rotating said turret arms and thereby positioning said winding roll away from said incoming sheet material while maintaining said rider roll on said winding roll, positioned such that a plane passing through the axes of rotation of said winding roll and said rider roll during said rotation of said turret arms maintains a constant angle with a horizontal plane during said rotation.

35. A turret winder assembly for winding incoming sheet material onto rolls, said assembly comprising:

(a) a frame;

(b) turret arms rotatably mounted to said frame;

(c) a winding roll rotatably mounted on said turret arms;

(d) means for positioning said winding roll toward said incoming sheet material, winding said sheet material onto said winding roll, and positioning a rotatably mounted rider roll on said winding roll at essentially the point of tangency between said incoming sheet material and said winding roll; and (e) means for rotating said turret arms and thereby positioning said winding roll away from said incoming sheet material while maintaining said rider roll on said winding roll, positioned such that a plane passing through the axes of rotation of said winding roll and said rider roll during said rotation of said turret arms maintains a constant angle with a horizontal plane during said rotation.

36. A method of winding an incoming sheet material onto a roll on a winder, said method comprising the steps of:

(a) winding said sheet material onto a winding roll having a first axis, said winding roll being driven by a winding drive;

(b) pressing a rider roll against said sheet material and said winding roll such that said incoming sheet material encounters said winding roll and said rider roll essentially simultaneously at essentially the locus of tangency between the winding surface of said winding roll and said incoming sheet material; and (c) adjusting the angular position of said rider roll with respect to said winding roll to maintain said rider roll at said locus of tangency during said winding operation.

37. A method as in claim 36, said winder being a turret winder having turret arms extending in at least two directions, said winding roll being mounted on one of said turret arms, and including rotating said turret arms while controlling the angular position of said rider roll such that said rider roll is maintained in position at said locus of tangency.

* * * * *